US006357568B1

(12) United States Patent
Chen

(10) Patent No.: US 6,357,568 B1
(45) Date of Patent: Mar. 19, 2002

(54) STRUCTURE FOR PROTECTING A LUGGAGE SHELL

(76) Inventor: Shou Mao Chen, 344,Sec.1,Chung Shan Rd., Ta Cha Township, Taichung Hsien (TW)

( * ) Notice: Subject to any disclaimer, the term of this patent is extended or adjusted under 35 U.S.C. 154(b) by 0 days.

(21) Appl. No.: 09/671,507

(22) Filed: Sep. 27, 2000

(51) Int. Cl.[7] ..... A45C 13/36
(52) U.S. Cl. ..... 190/37; 190/127; 48/345.1
(58) Field of Search ..... 190/35, 37, 127; 411/484; 248/345.1; 206/586

(56) References Cited

U.S. PATENT DOCUMENTS 459,251 A * 9/1891 Hall ..... 248/345.1 X
578,545 A * 3/1897 Crouch ..... 190/37 X
596,055 A * 12/1897 Crouch ..... 190/35
1,089,538 A * 3/1914 Davidson ..... 190/37 X
D114,962 S * 5/1939 Ortner ..... 190/37 X
2,610,715 A * 9/1952 Plotkin ..... 190/37 X
3,454,187 A * 7/1969 Rees ..... 190/37 X
3,836,043 A * 9/1974 Levin ..... 248/345.1 X
4,163,484 A * 8/1979 Delaney ..... 190/37 X
4,423,102 A * 12/1983 Danton ..... 428/911 X
5,263,229 A * 11/1993 Drummond ..... 411/484
5,525,384 A * 6/1996 Gilmore et al. ..... 248/345.1 X
6,206,195 B1 * 3/2001 Cheng ..... 248/348.1 X

* cited by examiner

*Primary Examiner*—Stephen P. Garbe
*Assistant Examiner*—Tri M. Mai
(74) *Attorney, Agent, or Firm*—Harrison & Egbert

(57) ABSTRACT

A structure is designed to protect the luggage shell and is formed of a base piece and a plurality of protective pieces which are partially embedded in the upper side of the base piece. The underside of the base piece is fastened to the outer surface of the luggage shell.

4 Claims, 6 Drawing Sheets

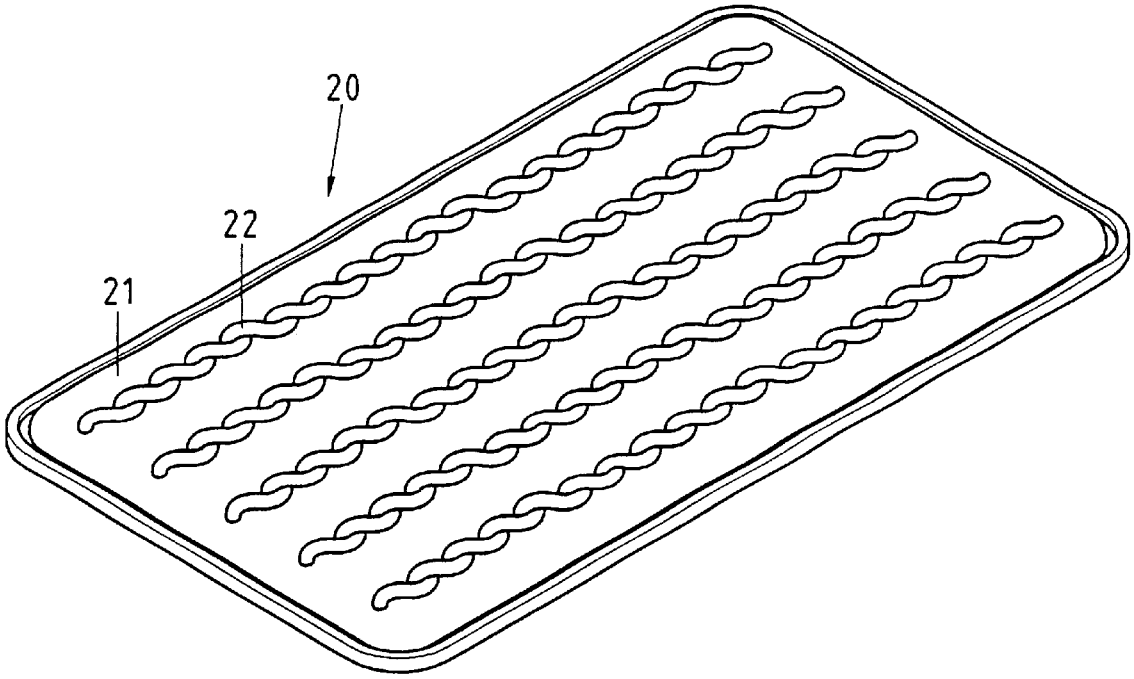
FIG.2
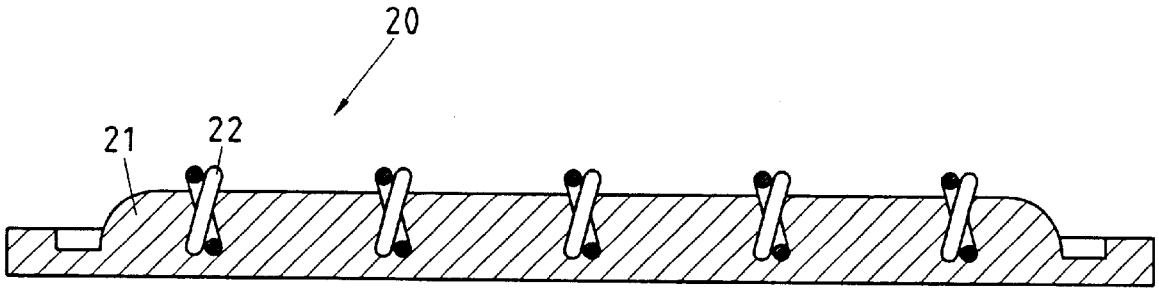
FIG.2-A

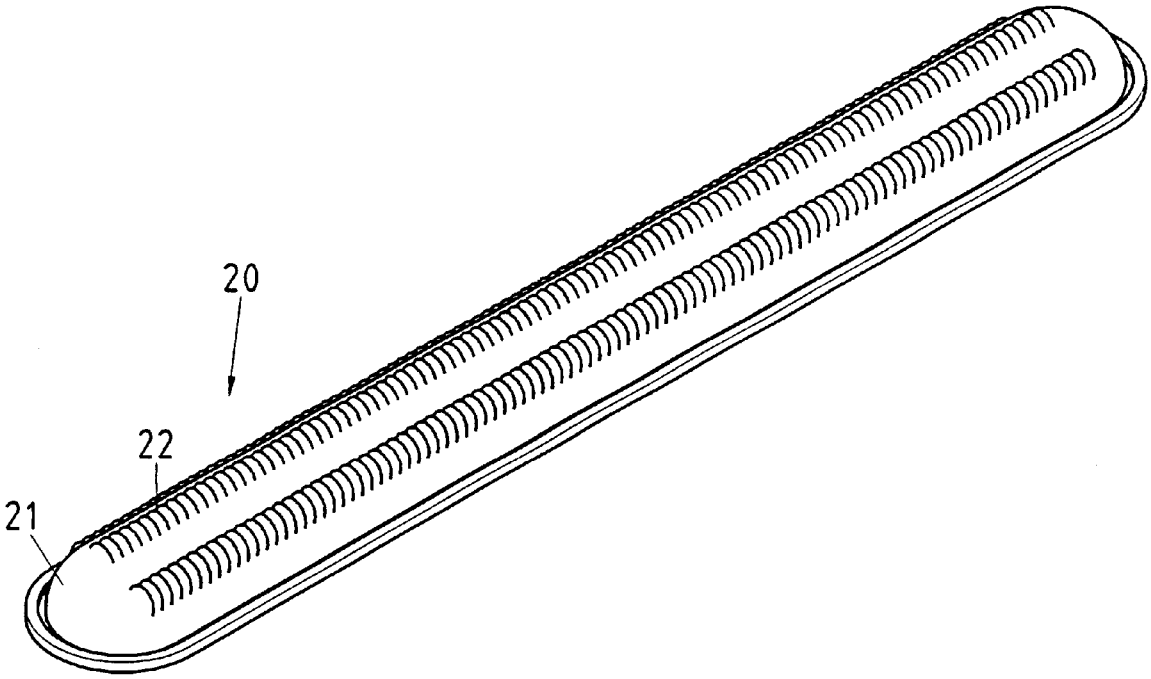
FIG.3
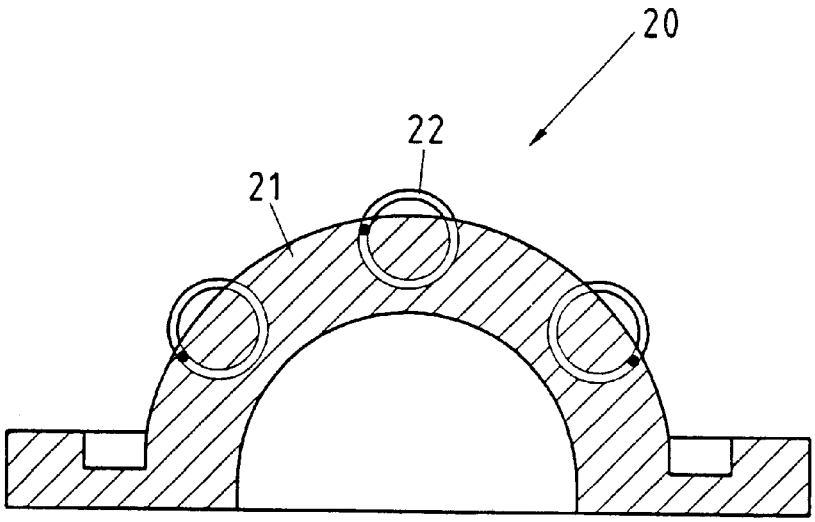
FIG.3-A

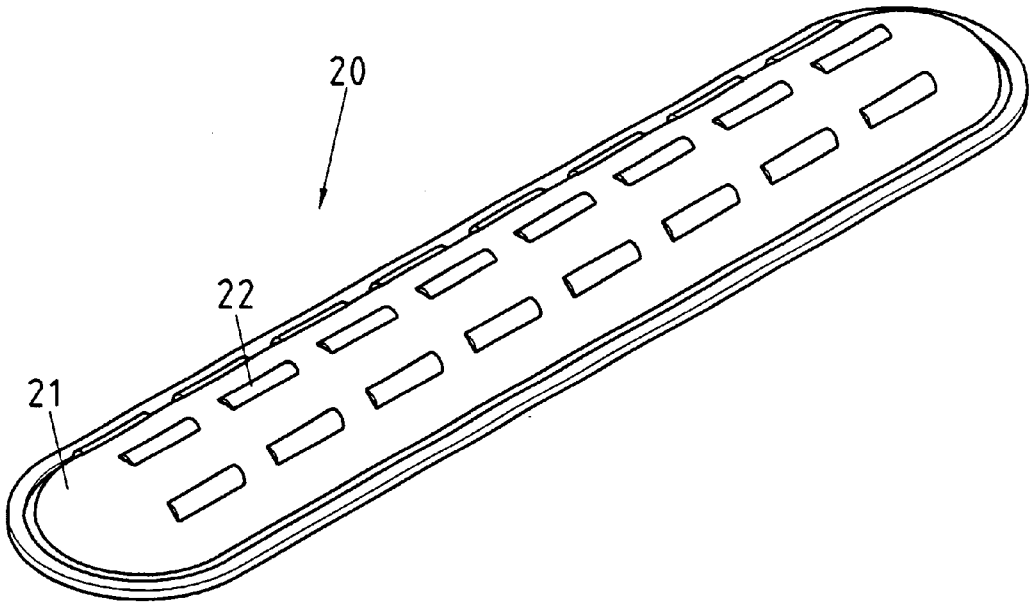
FIG.4
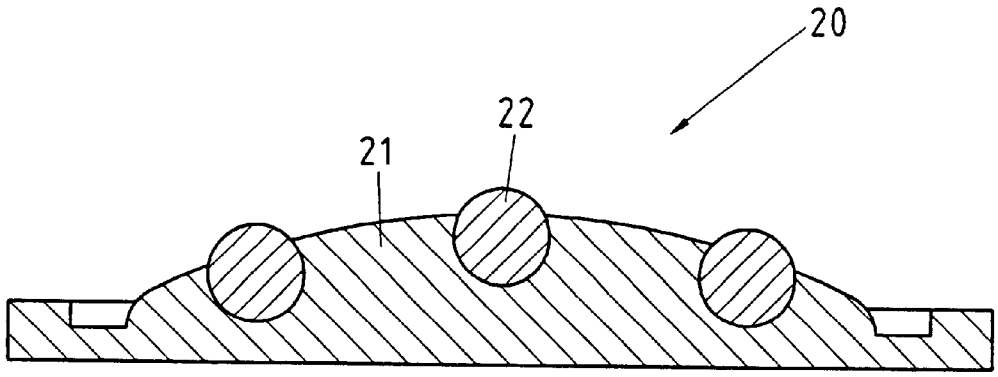
FIG.4-A

STRUCTURE FOR PROTECTING A LUGGAGE SHELL

BACKGROUND OF THE INVENTION

1. Field of the Invention

The present invention relates generally to luggage, and more particularly to a protective structure of luggage.

2. Description of Related Art

As shown in FIG. 1, a prior art protective strip 10 of luggage is rather monotonous in design and is in fact ineffective in protecting the luggage shell. The protective strip 10 is vulnerable to split and wear.

BRIEF SUMMARY OF THE INVENTION

The primary objective of the present invention is to provide a luggage shell with a protective structure resistant to impact.

It is another objective of the present invention to provide a luggage shell with a protective structure which gives an added aesthetic effect to the luggage shell.

The objectives, features and advantages of the present invention will be apparent from a reading of the attached specification and appended claims.

BRIEF DESCRIPTION OF THE SEVERAL VIEWS OF THE DRAWINGS

FIG. 2 shows a perspective view of the present invention.

FIG. 2A shows a cross-sectional view of the present invention as shown in FIG. 2.

FIG. 3 shows a perspective view of another embodiment of the present invention.

FIG. 3A shows a cross-sectional view of the present invention as shown in FIG. 3.

FIG. 4 shows a perspective view of still another present invention.

FIG. 4A shows a cross-sectional view of the present invention as shown in FIG. 4.

DETAILED DESCRIPTION OF THE INVENTION

Figure 1:
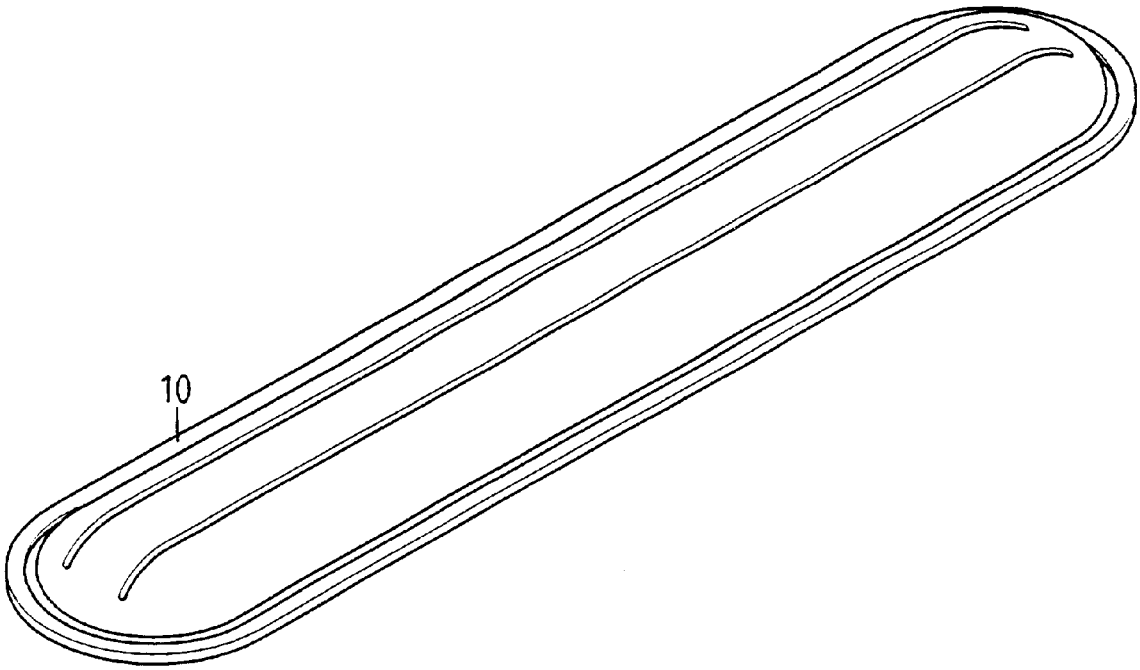
FIG.1 PRIOR ART
FIG. 1 shows a perspective view of a luggage protecting strip of the prior art.
Figure 5:
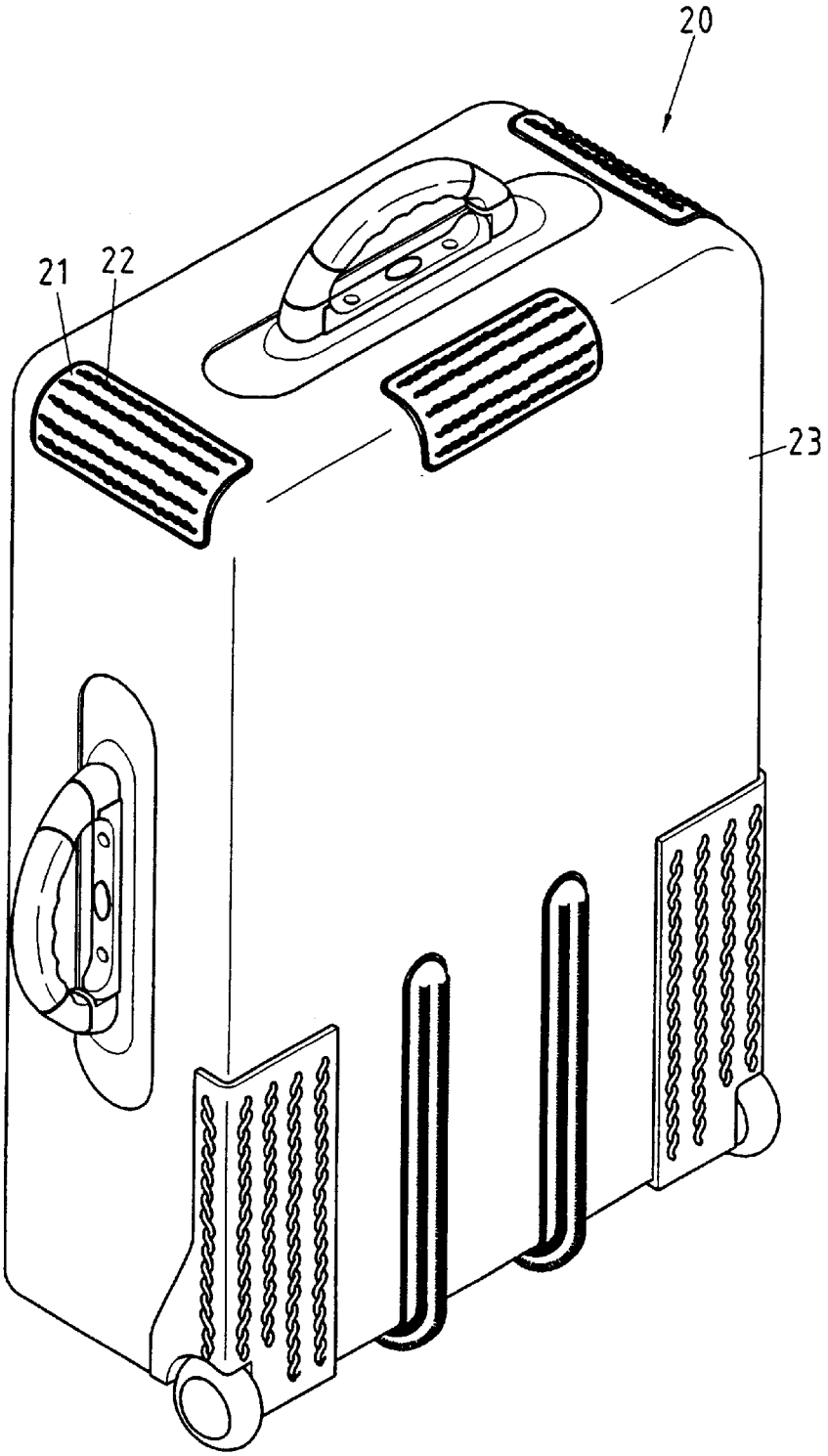
FIG. 5 shows a schematic view of the present invention in use.
Figure 6:
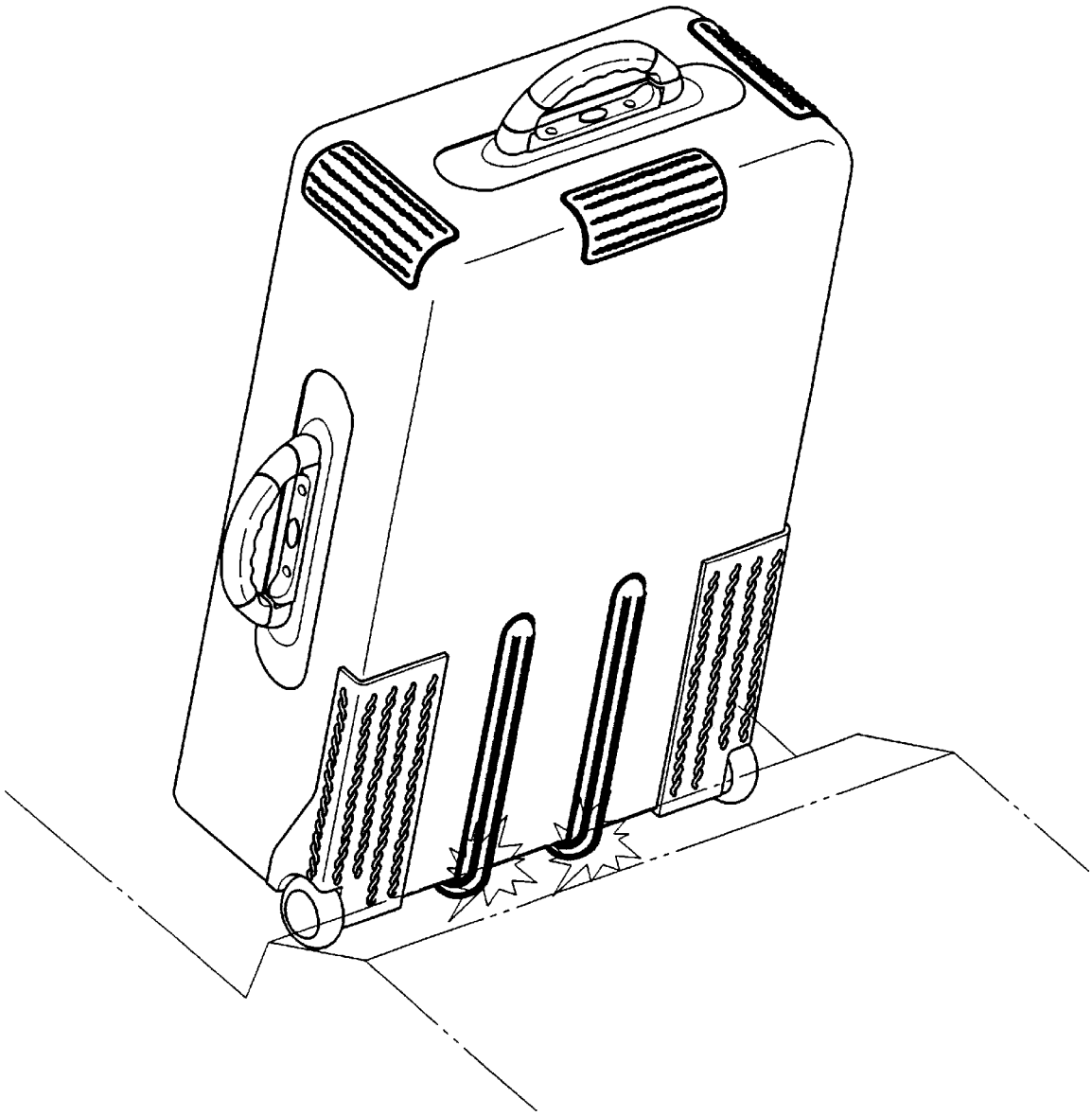
FIG. 6 shows a schematic view of the present invention at work.

As shown in FIGS. 2–6, a protective structure 20 embodied in the present invention is intended to protect the outer surface of a luggage shell 23.

The protective structure 20 comprises a base piece 21 and a plurality of protective pieces 22 which are partially embedded in the upper side of the base piece 21. The underside of the base piece 21 is fastened to the outer surface of the luggage shell 23.

The protective pieces 22 take various forms, such as a chain, spherical body, columnar body, etc. The protective pieces 22 may be made of a pliable or unpliable material. Preferably, the protective pieces 22 are coordinated in form and color with the luggage shell 23.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

I claim:

1. An apparatus comprising:

a luggage shell having an outer surface and a plurality of comers;

a base piece having an upper surface and a bottom surface, said bottom surface being fastened directly to said outer surface of said luggage shell across one of said plurality of corners; and a plurality of protective pieces partially embedded into said base piece so as to have a top portion extending outwardly of said upper surface of said base piece and a bottom portion located entirely interior of said base piece between said upper surface and said bottom surface.

2. The apparatus of claim 1, said plurality of protective pieces having a chain shape.

3. The apparatus of claim 1, said plurality of protective pieces having a circular cross-section.

4. The apparatus of claim 1, said plurality of protective pieces having a columnar form extending longitudinally along said base piece.

* * * * *